US005512010A

United States Patent [19]

Labad, Jr.

[11] Patent Number: 5,512,010

[45] Date of Patent: Apr. 30, 1996

[54] WET SANDING BLOCK

[76] Inventor: Georges Labad, Jr., 9095, rue Chauvet, Quebec, Quebec, Canada, G2K 1L1

[21] Appl. No.: 373,098

[22] Filed: Jan. 17, 1995

[30] Foreign Application Priority Data

Apr. 26, 1994 [GB] United Kingdom ..... 9408215

[51] Int. Cl.[6] ..... B24B 23/00; B24B 27/08

[52] U.S. Cl. ..... 451/344; 451/461; 451/524; 15/105

[58] Field of Search ..... 451/357, 458, 451/356, 490, 344, 461, 490, 523, 524, 525, 544, 547; 15/105; 7/124, 170

[56] References Cited

U.S. PATENT DOCUMENTS

| | | | |
|---|---|---|---|
| 539,313 | 5/1895 | Thierry et al. . | |
| 846,665 | 3/1907 | Hames | 451/524 |
| 4,023,312 | 5/1977 | Stickney | 451/357 |
| 4,054,626 | 10/1977 | Sjostrand . | |
| 4,091,579 | 5/1978 | Giangiulio | 451/461 |
| 4,320,601 | 3/1982 | Haney . | |
| 4,839,995 | 6/1989 | Hutchins | 451/357 |
| 4,922,665 | 5/1990 | Wanatowicz . | |
| 5,022,190 | 6/1991 | Hutchins . | |
| 5,193,313 | 3/1993 | Sanchez et al. | 451/524 |
| 5,245,797 | 9/1993 | Mickie | 451/525 |

FOREIGN PATENT DOCUMENTS

| | | | |
|---|---|---|---|
| 2051514 | 3/1993 | Canada . | |
| 549202 | 6/1993 | European Pat. Off. | 451/450 |
| 2257393 | 8/1975 | France | 451/524 |
| 2533853 | 10/1982 | France . | |
| 544556 | 6/1956 | Italy . | |

*Primary Examiner*—Bruce M. Kisliuk
*Assistant Examiner*—Derris Banks

[57] ABSTRACT

The present invention relates to a new and improved manual wet sanding block having means for supplying liquid from an external source through the wet sanding block onto a surface being sanded, a means for wipe drying a newly sanded surface, a flexible hose connected to an adaptor located on the wet sanding block, a sliding sucker fixed on the hose near the body in order to avoid that the flexible hose touch the floor, and a means for hanging up the wet sanding block in order the avoid the rust. The flow of water is first controlled by a regulator located in a water intake but may instantly be started and stopped by the finger of the operator. The water is delivered onto the sanding surface by perforations located under the wet sanding block.

15 Claims, 6 Drawing Sheets

WET SANDING BLOCK

BACKGROUND—FIELD OF INVENTION

This invention relates to the field of manually operated abrasive tools, in particular, the sanding finishing of car and truck bodies.

The present invention relates to a new and improved manual wet sanding block having means for supplying liquid from an external source through the wet sanding block onto a surface being sanded, a means for wipe drying a newly sanded surface, a flexible hose connected to an adaptor located on the wet sanding block, a sliding sucker fixed on the hose near the body in order to avoid that the flexible hose touch the floor, and a means for hanging up the wet sanding block in order the avoid the rust. The flow of water is automatically controlled by a regulator located in a water intake. The water is delivered onto the sanding surface by perforations located under the wet sanding block.

BACKGROUND—DESCRIPTION OF PRIOR ART

A prior art patent search was conducted and a list of patents which appeared to us to be most pertinent to the invention follows:

U.S. Pat. No. 5,022,190 Hutchins, Jun. 11, 1991, shows a mechanical wet sanding tool comprising a hose with liquid flowing from an external source through the wet sanding tool onto a surface being sanded, and by openings in the abrasive surface. The invention of Hutchins comprises a channel network in order to distribute the water in the body of the wet sanding tool, whereas my invention does not include this channel network which is not necessary and augments fabrication and tooling costs. Furthermore, the abrasive surface of Hutchins (FIG. 6) comprises holes for the flowing of water, this implies that somebody has to pierce some holes for delivering water onto the abrasive surface or buy a special sandpaper which may not be easy to find. U.S. Pat. No. 4,320,601 Haney, Mar. 23, 1982, shows a wet sander which comprises an outlet for continuous spraying of water towards the front of the wet sander. This wet sander comprises a valve to control the flow of water. A peculiarity of this invention is to distribute the water by a spray in front of the wet sander. This peculiarity seems to limit the use of the wet sander to horizontal surfaces and sometimes to vertical surfaces when the spray of water is upwardly oriented. U.S. Pat. No. 4,054,626 Sjostrand, Oct. 18, 1977, describes a method for forming bodies of foamed plastisol resin having few steps: heating a fluid plastisol to form a solidified body, grinding the solidified body to form an aggregate, depositing the aggregate into a mold cavity for a closed mold and heating the aggregates within the mold cavity. With a plastic block, the object of this patent, Sjostrand has imagined a water conduit embedded in this block and describes it under the name of EEZER DUSTLESS, but without precise components for making a usable tool in industry. CAN 2051514 Yarbrough, Mar. 17, 1993, shows water-filtered vacuum wall sander to recuperate dust through a porous abrasive surface and a water filter. FR 2533853 Caillot, Oct. 4, 1982, describes a vibrative mechanical sander with an abrasive surface comprising two half soles related to a half shell and comprising flexible columns placed in a direction parallel to that of a sanding plane, without water conduit. IT 544556 Stoll, 1956, shows a vibrative and rotative mechanical sander, with clamps for retaining sandpaper (FIG. 1). U.S. Pat. No. 4,922,665 Wanatowicz, May 8, 1990, shows a manual wet sander comprising a flexible hose. The water is forwarded onto a sanding surface through the wet sander by a hose. A canal network regulates the flow of water to a plurality of liquid outlets along both sides of the wet sander in order not to impregnate the sandpaper with water. This wet sander comprises means for controling the flow by an external pressurized source adjustable by a tap and by means for strangling which are simply distributing water in a system of a small channel where the ratio channel length vs channel diameter is high. But this wet sander does not have means located on the block for controlling the flow. This invention can be used on vertical surfaces with edge strips disposed along both sides, but cannot be used on convex surfaces because the water is directed towards the sides: the invention uses a standard (9×11 inches) sandpaper which may not, without difficulty, espouse the form of a convex surface.

The conventional method consits in soaking a sponge in a water bucket, to squeeze the sponge onto a body in order to extract the water, to moisten a sandpaper which is fixed on a manual sanding block, with water flowing away from the sponge at the moment of a sanding operation. The results of this conventional method are somebody has to bend over to soak his sponge in the water bucket, with possible pain at the back; moreover the user has to often have his hands in viciated water with risks of skin infection.

While study of the prior art shows several inventions proposing solutions to the problem of supplying water, none has the means or capabilities of providing multiple controls at the finger tip of the user.

SUMMARY OF THE INVENTION

The main objective of the invention is to provide better working conditions for a bodyshop worker while involved in car and truck finishing sanding and to remedy the inconvenients of the conventional method and other inconvenients of the patents mentioned above.

A more particular objective is to provide a combination comprising a wet sanding block, a sandpaper, a means for controling the flow of water at the source, a means of buffer reservoir for distributing water onto a sanding surface in order to avoid sandpaper stuffing, a means for fixing a sandpaper, a means for hooking a wet sanding block for dripping, a means for supplying water into a wet sanding block, a means for slidingly attaching a flexible hose while sanding for avoiding dragging of the hose along a floor and for keeping the means for delivering water within the reach of a user and, finally a means for wipe drying which permits to immediately verify the state of the work.

DRAWINGS

The above mentioned and other advantages of the invention will be better understood in reference to the drawings.

In the drawings, closely related figures have the same number, as the ones appearing in the description of the invention.

FIG. 1 a perspective view of the wet sanding block designed for a left-handed user, the observer being at the bask and on the right.

DESCRIPTION OF THE INVENTION

Figure 1:
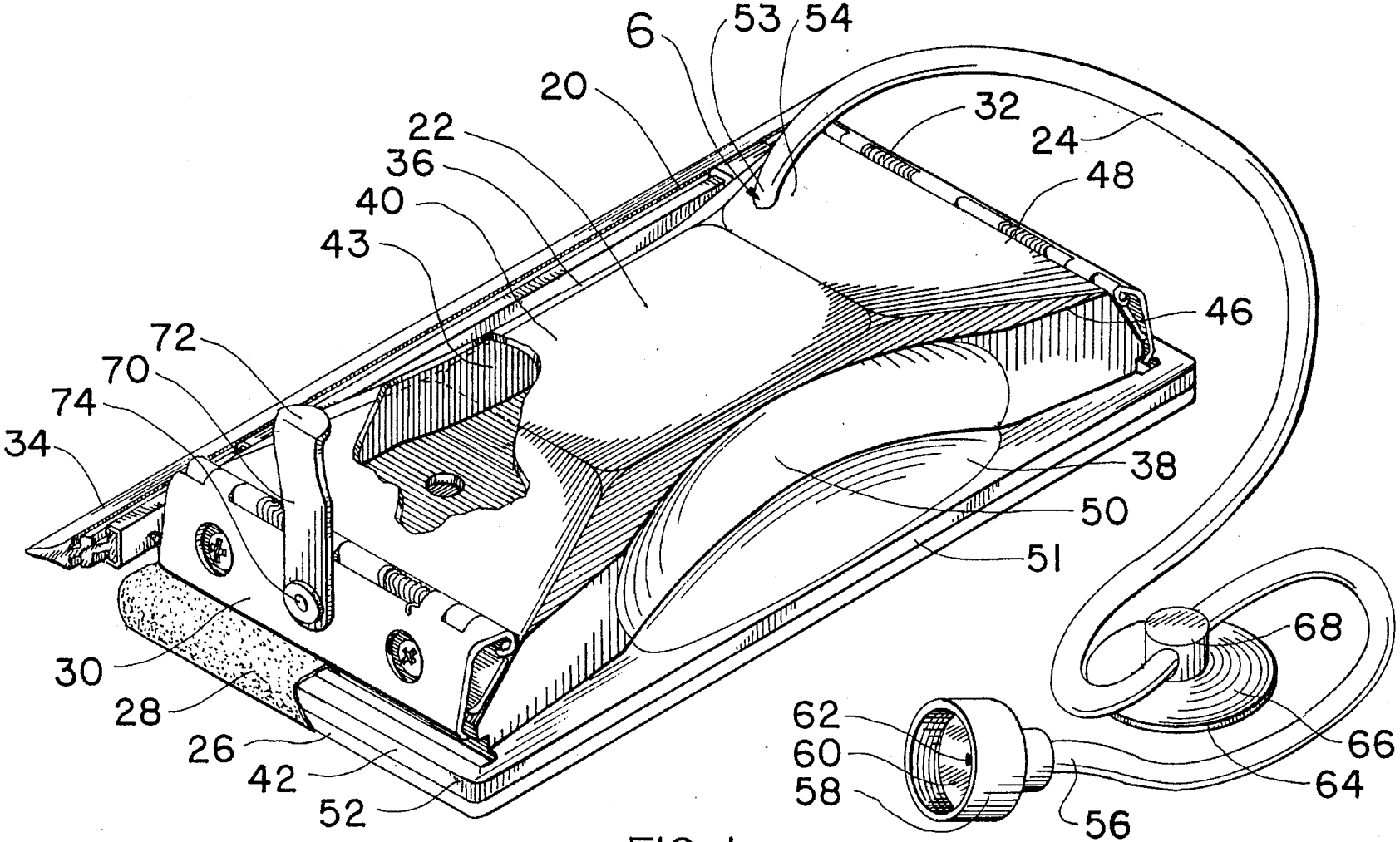

The preferred embodiment of the invention is illustrated in FIG. 1 where one can see:

a wet sanding block 20, which has a generally parallelepiped form, adapted for finishing sanding of car and truck bodies. The wet sanding block 20 comprises a hollow rigid base 22 which serves to manipulate and to distribute water in the wet sanding block 20, a flexible hose 24 connected to the rigid base 22 which brings water into the rigid base 22, a resilient surface 26 located under the rigid base 22 and serving to support a sandpaper 28 and to release the water accumulated in the rigid base 22, a first spring clamp 30 and a second spring clamp 32 located respectively on each extremity of the rigid base 22 and serving to fix the sandpaper 28 and a rubber flexible wiper 34 located on a left side 36 of the rigid base 22 for a left-handed user, and on a right side 38 for a right-handed person and serving to wipe dry the body.

The rigid base 22, which has a generally parallelepiped form is designed for the ergonomic comfort of the hand of a user. The rigid base 22 comprises a top 40, a flat bottom 42, the right side 38, the left side 36, a hollow interior 43, the first spring clamp 30 fixed on a back extremity 44 (FIG. 3) and the second spring clamp 32 fixed on a front extremity 45. The top 40 has a generally rectangular shape and two long superior sides 46 and two short superior sides 48. The left side 36 and the right side 38 show concavities 50 for grasping the wet sanding block 20. The flat bottom 42 has a generally rectangular shape, two long inferior sides 51 and two short inferior sides 52.

The flexible hose 24 comprises a first end 53 connected on a front left corner 54 of the top 40 which corresponds to the index position of a left-handed user. A second end 56 of a flexible hose 24 has a water intake 58 adaptable onto a tap. The water intake 58 comprises a circular-shaped regulator 60 with a central orifice 62 of about 0,5 mm. The flexible hose 24 comprises a sucker 64 composed of a rubber dome 66 and a holed cylinder 68. The holed cylinder 68 allows the displacement of the sucker 64 along the flexible hose 24 in order to obtain the appropriate length of flexible hose 24 required for the work.

The resilient surface 26 is stuck onto the flat bottom 42 of the rigid base 22. The resilient surface 26 has a generally rectangular shape of the same dimensions as long inferior sides 51 and short inferior sides 52 of the flat bottom 42.

The first spring clamp 30 (FIG. 3) is fixed to the back extremity 44 and comprises in its centre an L-shaped lever arm 70 (FIG. 1). The L-shaped lever arm 70 include a hook 72 at an extremity and a pivoting hole 74 at the other extremity. The L-shaped lever arm 70 is used in a first position at 90° to the first spring clamp 30 in order to accomplish two functions. A first function of the L-shaped lever arm 70 is to open the first spring clamp 30 in order to install an extremity of the sandpaper 28. A second function of the L-shaped lever arm 70 is to hang up the wet sanding block 20 in order to favour the dripping of the water when the wet sanding block 20 is not being used. This second function of the L-shaped lever arm 70 permits the extension of the life of the wet sanding block 20 because it cannot rust, and permits not storing the wet sanding block 20 in a tool box, in order to prolong the life of the tool too. The L-shaped lever arm 70 has a second position parallel to the first spring clamp 30 in order to clear the visual field and to allow for easy manipulation of the wet sanding block 20. The second spring clamp 32 is fixed to the front extremity 45 (FIG. 3).

Figure 2:
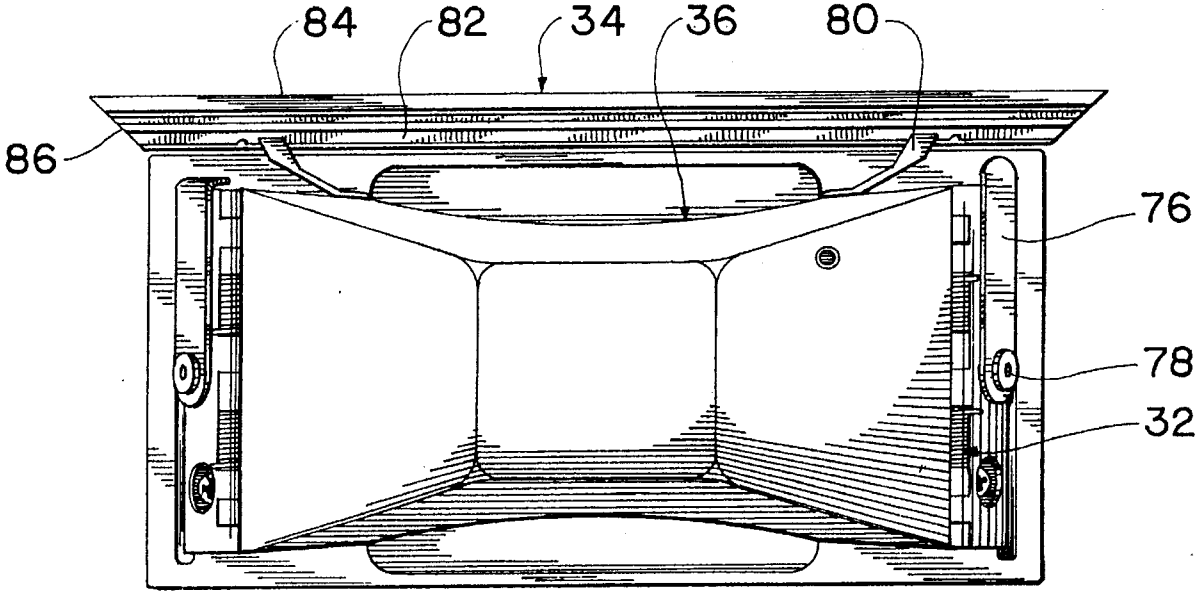
FIG. 2 is a top plan view of the block of FIG. 1.

FIG. 2 shows a detail of the second spring clamp 32 which has a lever arm 76 with a pivoting hole 78 in an extremity.

The flexible wiper 34 is held on the left side 36 by two spread apart attachments 80. The flexible wiper 34 has a trapezoidal form and has a rigid plastic short base 82, a rubber long base 84 and two sides 86 which relate the short base 82 to the long base 84. The short base 82 has the same length as the left side 36 of the rigid base 22. The long base 84 is larger, by at least ⅛ inch, than the short base 82 in order to avoid that the rigid plastic short base 82 scratch the body. The flexible wiper 34 is adapted to wipe dry while espousing the body rounded shape by means of a rotation back and forth of a hand holding the wet sanding block 20.

Figure 3:
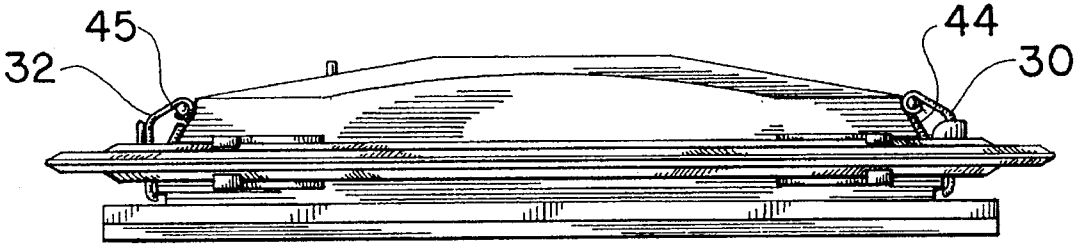
FIG. 3 is an elevation left side view thereof.

FIG. 3 shows a detail of the first spring clamp 30 fixed at the back extremity 44 and the second spring clamp 32 fixed at the front extremity 45.

Figure 4:
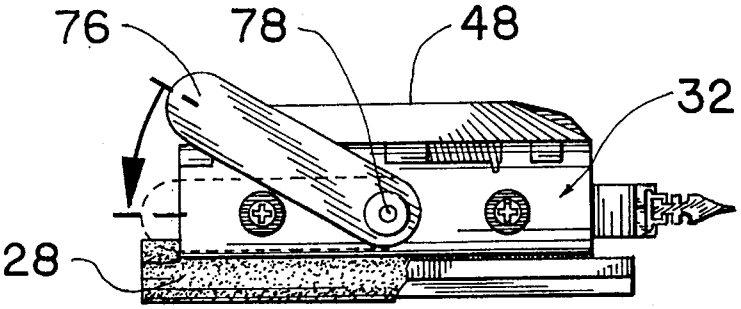
FIG. 4 is an end view thereof.

FIG. 4 shows a detail of the lever arm.76 pivoting about the pivoting hole 78. The lever arm 76 is used in a first position at 90° to the short superior side 48 as a lever for the opening of the second spring clamp 32, to fix another extremity of the sandpaper 28. The lever arm 76 is also used in a second position parallel to the short superior side 48, to clear the way.

Figure 5:
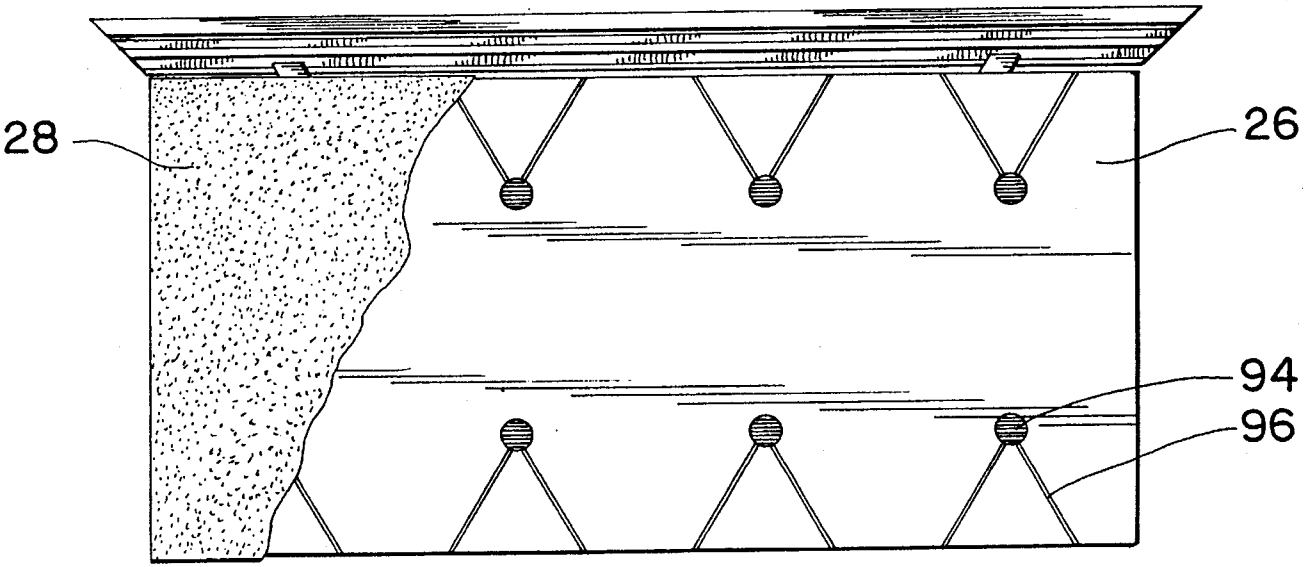
FIG. 5 is a bottom plan view with partial cut.

FIG. 5 shows a detail of the resilient surface 26 which comprises eight perforations 94 distributed over two lines and four columns wherein the spacing is equidistant, and further comprises V-shaped grooves 96. The perforations 94 correspond to the junction point of the two branches of a V orientated towards the exterior of the resilient surface 26. The flat bottom 42 also displays the eight perforations 94. The rigid base 22 has a hollow interior 43 (FIG. 1) which serves as a water reservoir and eventual distributor through the resilient surface 26. The hollow interior 43 has a capacity of 200 ml and the eight perforations 94 have a diameter of 2 mm each.

Figure 6B:
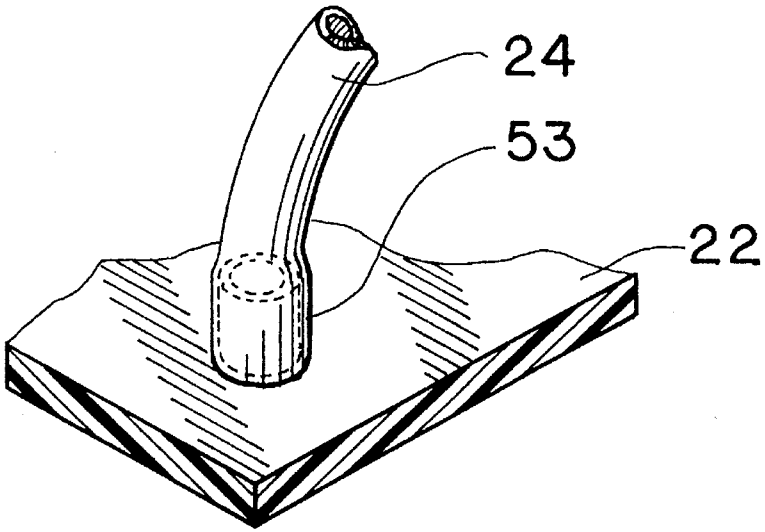
FIG. 6A and 6B are perspective views of a detail in the region of arrow 6 of FIG.1.
Figure 6A:
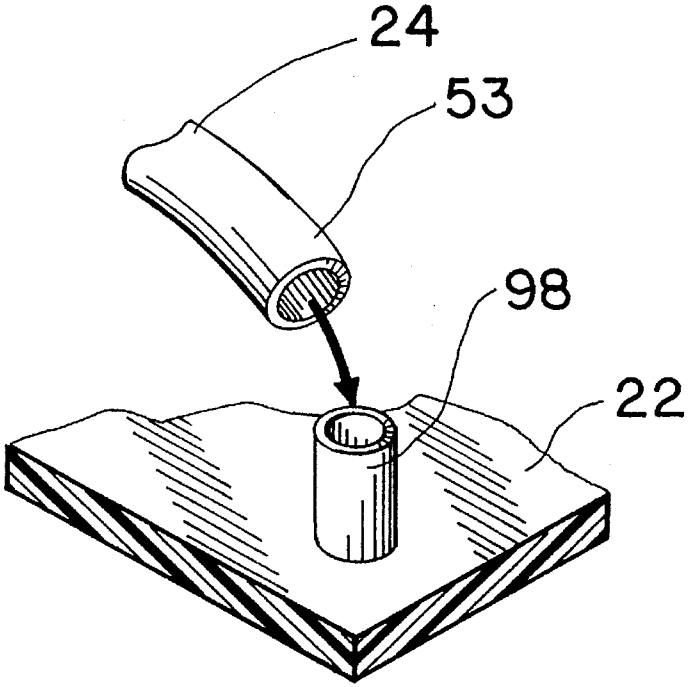

FIG. 6A shows a detail of a cylindrical adaptor 98 adapted to receive a first end 53 of a rubber flexible hose 24 which brings water into the hollow interior 43 of the rigid base 22. FIG. 6B shows a detail of the first end 53 connected to the adaptor 98. For cutting the water supply, the user crush the first end 53 of the flexible hose 24 with his index to bend in two the flexible hose 24. The flexible hose 24 has a diameter of 3 mm.

Figure 7:
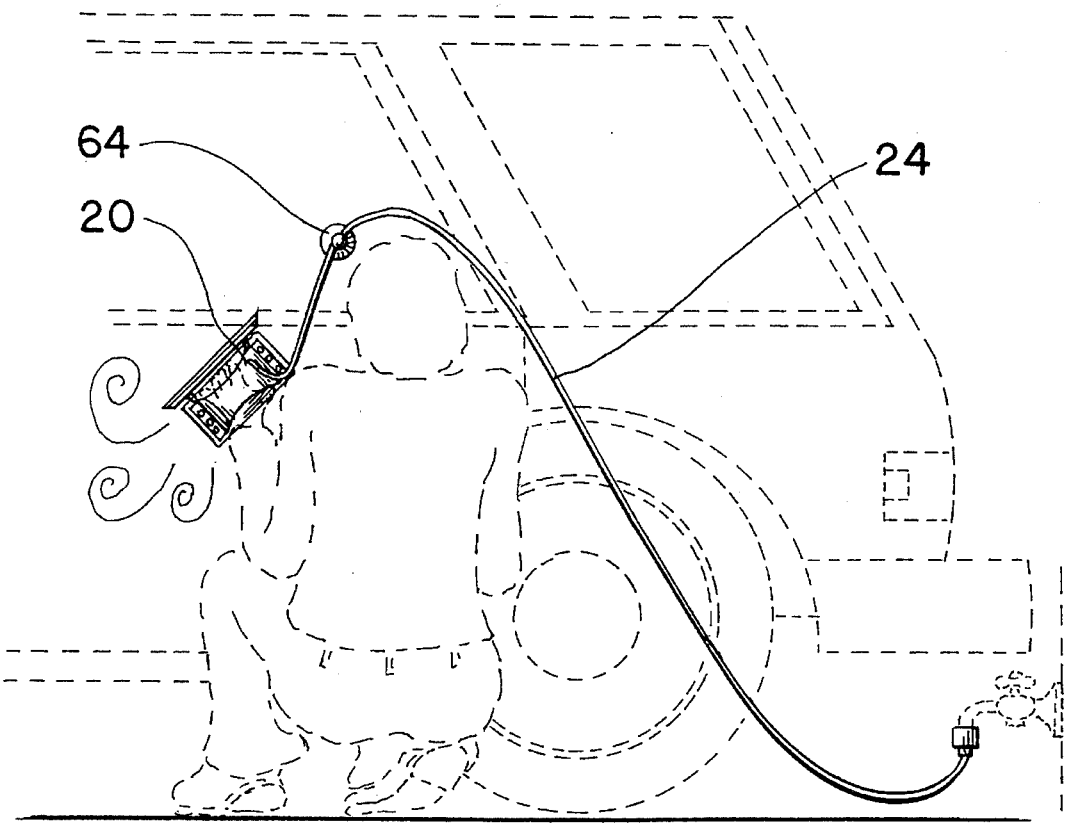
FIG. 7 is a view illustrating a way to use the wet sanding block.

FIG. 7 shows a way to work with the wet sanding block 20 connected on the flexible hose 24 in order to obtain a continuous flow of water onto the sanding surface. The flexible hose 24 is maintained on the surface of the body by a sucker 64.

Figure 8:
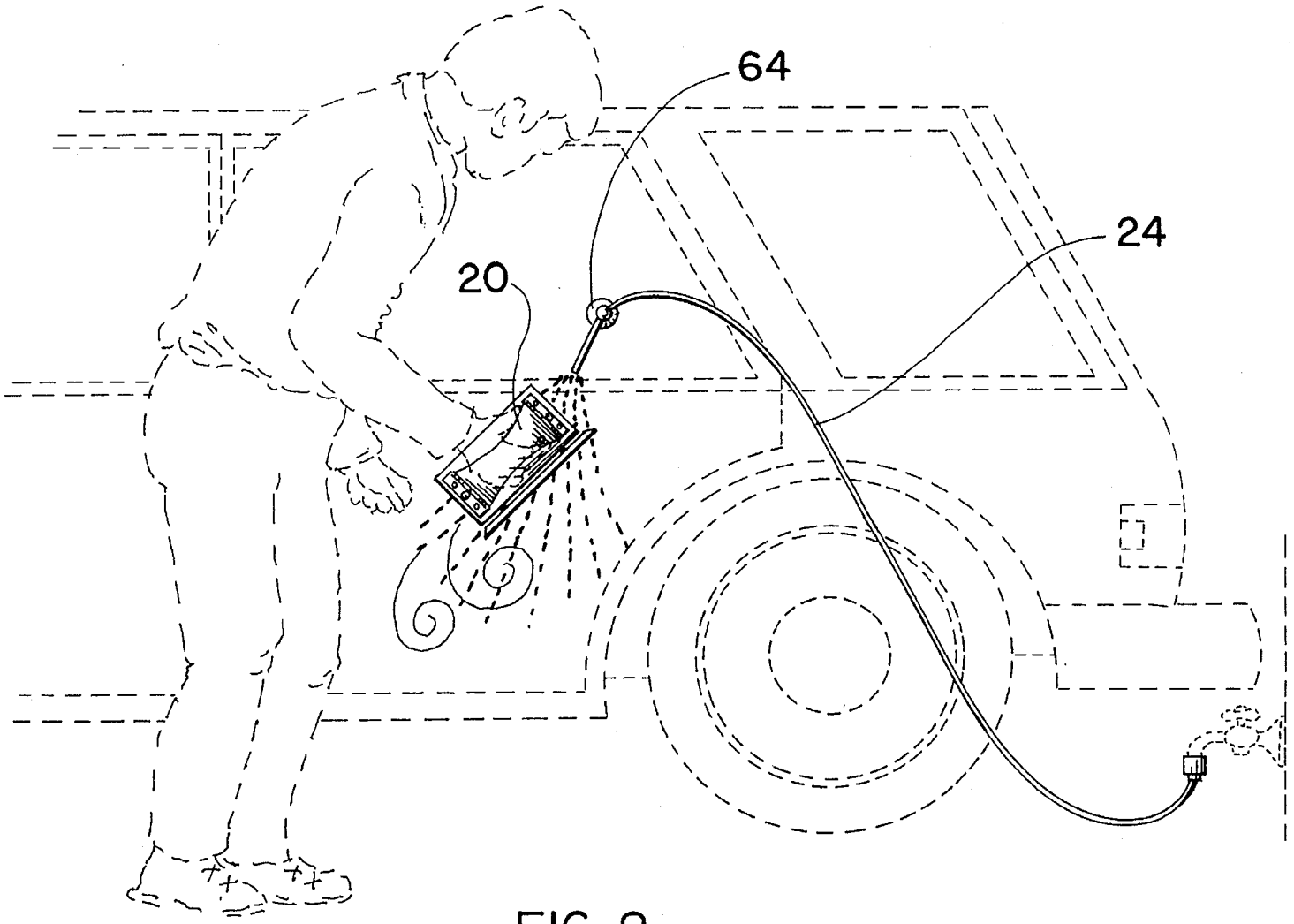
FIG. 8 is a view illustrating another way to use the wet sanding block.

FIG. 8 shows another way to work with the wet sanding block 20 and the flexible hose 24 without connecting them together, while sanding with a continuous flow of water for cleaning the sanding surface. The flexible hose 24 is maintained on the body by a sucker 64.

My invention is used with a standard size of sandpaper (9×11 inches) which is cut in two in the longitudinal direction in order to obtain a narrow abrasive surface. This characteristic has the advantage of better espousing round '90 bodies and permitting a better versatility of user's movements. Furthermore, my invention does not comprise a channel system for distributing the water through the interior of the wet sanding block towards the exterior sides; a channel system is not necessary and results in supplementary fabrication costs.

The present invention has the effect to accomplish the finishing sanding of bodies more rapidly and more efficiency. For example, with my wet sanding block, a user can realize 20% time economy while finishing sanding of a body, because of the operation of wipe drying integrated to the procedure of sanding, by quickly moving the hand from sanding to wipe drying and back to sanding. My invention has an aim to supply an integrated means for wipe drying which consists of a flexible wiper fixed to the wet sanding block. The user can wipe dry the body with a simple movement of the arm, so he can see immediately the state of the finishing sanding before the particles become dry. This flexible wiper is particularly useful when a user is sanding painted bodies, with colours, like black, for which the sanding finishing is more difficult to achieve with conventional means for drying. This integrated means for wipe drying avoids using slow and inefficient means for wipe drying like fabric, paper or compressed air. Furthermore, the flexible wiper permits to reduce the drying time and hence to augment the productivity of the user.

Although the above description contains many specificities, these should not be construed as limiting the scope of the invention but as merely providing illustrations of some of the presently preferred embodiments of this invention.

Thus the scope of the invention should be determined by the appended claims and their legal equivalents, rather than by the examples given.

LIST OF PARTS 20 wet sanding block
22 hollow rigid base
24 flexible hose
26 resilient surface
28 sandpaper
30 first spring clamp
32 second spring clamp
34 flexible wiper
36 left side
38 right side
40 top
42 flat bottom
43 hollow interior
44 back extremity
45 front extremity
46 long superior side
48 short superior side
50 concavity
51 long inferior side
52 short inferior side
53 first end
54 front left corner
56 second end
58 water intake
60 regulator
62 central orifice
64 sucker
66 dome
68 holed cylinder
70 L-shaped lever arm
72 hook
74 pivoting hole
76 lever arm
78 pivoting hole
80 attachments
82 short base
84 long base
86 side
94 perforation -continued

LIST OF PARTS 96 grooves
98 adaptor

I claim:

1. A wet sanding block, adapted for the finishing sanding of car and truck bodies, comprising in combination:

a rigid base comprising a flat bottom and a means for manipulating parallel to said flat bottom, said flat bottom having a generally rectangular shape and having perforations, two long inferior sides, two short inferior sides and a longitudinal axis;

a means for sanding adapted to be placed under said flat bottom and comprising a means for fixing to maintain said means for sanding under said flat bottom;

a buffer reservoir supported by said rigid base and adapted to distribute a liquid under said flat bottom by said perforations for spilling said liquid over said bodies in an area to be finishing sanded;

a means for wipe drying located parallel to said two long inferior sides of said flat bottom and adapted to wipe dry a newly sanded surface in order to immediately verify the appearance of said surface;

said means for manipulating adapted to turn from a first sanding position towards a second wipe drying position according to a rotative movement about said longitudinal axis of said flat bottom; in said first sanding position, said flat bottom being parallel to said body and adapted to enter into contact with said body; in said second wipe drying position, said flat bottom being at a certain angle in reference to said body and in reference to said means for wipe drying while in contact with said body.

2. A wet sanding block as defined in claim 1 wherein said rigid base has a parallelepiped shape and further comprises, a top, a right side, a left side, a front extremity, a back extremity and a hollow interior adapted to receive said buffer reservoir, said top having a generally rectangular shape and comprising two long superior sides and two short superior sides, said rigid base further comprising means for supplying water towards said buffer reservoir.

3. A wet sanding block as defined in claim 2 wherein said means for sanding is a sandpaper and wherein said means for fixing is a first spring clamp located on said back extremity and a second spring clamp located on said front extremity of said rigid base, said first spring clamp comprising an L-shaped lever arm adapted to serve as a hook for said wet sanding block, when not in use, and when dripping.

4. A wet sanding block as defined in claim 2 wherein said means for wipe drying is a flexible wiper located on said right side for a right-handed user, with two attachments located on said right side, one near said front extremity, the other near said back extremity, the centre of said flexible wiper being free to permit the adapting of said flexible wiper to a curved surface of said body, likewise for a left-handed user.

5. A wet sanding block as defined in claim 2 wherein said flat bottom is covered by a resilient surface overlay extending over said long inferior sides, said resilient surface adapted to protect said sandpaper and further comprising V-shaped grooves extending from a junction point of two V branches originating at said perforations, said V branches oriented towards an exterior limit of said long inferior sides at the level of said resilient surface.

6. A wet sanding block as defined in claim 4 wherein said means for manipulating is a pair of concavities comprising a right concavity in said right side and a left concavity in said left side, said pair of concavities adapted to receive a user's hand using said rigid base by uniplanar circular motions of sanding, and for movements of rotation about said longitudinal axis for alternatively presenting said flexible wiper and said means for sanding to a surface of a car and truck to be sanded.

7. A wet sanding block as defined in claim 2 wherein said top comprising an adaptor located near a junction point at the limit of said left side and said front extremity, in front of said left concavity for said left-handed user, said adaptor adapted to receive said means for supplying water.

8. A wet sanding block as defined in claim 7 wherein said means for supplying water is a flexible hose comprising a first end and a second end, said first end comprising a water intake and said second end adapted to be connected on said adaptor in order to reached by a user's finger for squeezing and hence cutting the flow of water.

9. A wet sanding block as defined in claim 8 wherein said water intake comprises a means for regulating being incorporated in a female connection adapted to said water intake.

10. A wet sanding block as defined in claim 9 wherein said means for regulating is a thin washer comprising a central orifice with a diameter of 0.2 to 0.5 mm and adapted to be inserted into the interior of said female connection.

11. A wet sanding block as defined in claim 8 wherein said flexible hose further comprises a suction apparatus adapted to adhere to said body and comprising a sliding channel adapted to adjust the length of said flexible hose between said sliding channel and said wet sanding block in order to minimize twisting of said flexible hose during sanding operation.

12. A wet sanding block as defined in claim 4 wherein said flexible wiper has a trapezoidal shape and comprises a rigid plastic short base, a rubber long base and two sides related to said short base and said long base, said flexible wiper being retained to said rigid base by two attachments.

13. A wet sanding block as defined in claim 1 wherein said short base has the same length as said right side and said left side of said rigid base.

14. A wet sanding block as defined in claim 13 wherein said long base exceeds in length ⅛ inches that of said short base in order to avoid that said rigid plastic short base scratches a body.

15. A wet sanding block of claim 9 wherein said first end of said flexible hose is adapted to be bent in two by said right-handed user or said left-handed user, in order to cut the flow of water.

* * * * *